US005819760A

United States Patent [19]

Wimer

[11] Patent Number: 5,819,760

[45] Date of Patent: Oct. 13, 1998

[54] COLOR CHANGING PERMANENT ROD SYSTEM

[76] Inventor: Patricia E. Wimer, 1380 Oakhill Dr. #74, Escondido, Calif. 92027

[21] Appl. No.: 44,315

[22] Filed: Mar. 19, 1998

[51] Int. Cl.[6] ..... A45D 7/04

[52] U.S. Cl. ..... 132/207; 132/248; 132/229; 132/233; 132/208

[58] Field of Search ..... 132/207, 203, 132/208, 212, 247, 248, 245, 233, 228, 229, 262

[56] References Cited

U.S. PATENT DOCUMENTS

| | | | |
|---|---|---|---|
| 3,658,071 | 4/1972 | Wise | 132/233 |
| 3,696,819 | 10/1972 | Jensen | 132/233 |
| 4,028,118 | 6/1977 | Nakasuji et al. | 106/21 |
| 4,421,560 | 12/1983 | Kito et al. | 106/21 |
| 4,465,085 | 8/1984 | Schopieray | 132/248 |
| 4,699,160 | 10/1987 | Wiggin | 132/248 |
| 4,732,169 | 3/1988 | Van Sickle | 132/248 |
| 5,297,567 | 3/1994 | Summerville et al. | 132/227 |
| 5,487,396 | 1/1996 | Wilson | 132/248 |
| 5,606,983 | 3/1997 | Monty et al. | 132/229 |

*Primary Examiner*—Gene Mancene
*Assistant Examiner*—Philagene Pedro

[57] ABSTRACT

A plurality of permanent rods are included which change color in response to a solution coming contact therewith for the purpose of indicating that the hair has the solution applied thereto.

6 Claims, 2 Drawing Sheets

COLOR CHANGING PERMANENT ROD SYSTEM

BACKGROUND OF THE INVENTION

1. Field of the Invention

The present invention relates to permanent rods and more particularly pertains to a new color changing permanent rod system for indicating whether hair has a permanent wave solution applied thereto.

2. Description of the Prior Art

The use of permanent rods is known in the prior art. More specifically, permanent rods heretofore devised and utilized are known to consist basically of familiar, expected and obvious structural configurations, notwithstanding the myriad of designs encompassed by the crowded prior art which have been developed for the fulfillment of countless objectives and requirements.

Known prior art permanent rods include U.S. Pat. No. 5,193,558; U.S. Pat. No. 5,144,968; U.S. Pat. No. 4,993,441; U.S. Pat. No. 4,635,655; and U.S. Pat. Des. 259,816.

In these respects, the color changing permanent rod system according to the present invention substantially departs from the conventional concepts and designs of the prior art, and in so doing provides an apparatus primarily developed for the purpose of indicating whether hair has a permanent wave solution applied thereto.

SUMMARY OF THE INVENTION

In view of the foregoing disadvantages inherent in the known types of permanent rods now present in the prior art, the present invention provides a new color changing permanent rod system construction wherein the same can be utilized for indicating whether hair has a permanent wave solution applied thereto.

The general purpose of the present invention, which will be described subsequently in greater detail, is to provide a new color changing permanent rod system apparatus and method which has many of the advantages of the permanent rods mentioned heretofore and many novel features that result in a new color changing permanent rod system which is not anticipated, rendered obvious, suggested, or even implied by any of the prior art permanent rods, either alone or in any combination thereof.

To attain this, the present invention generally comprises a plurality of permanent rods. Each rod includes a central portion having a cylindrical configuration and a pair of ends. As shown in FIG. 1, each end of the central portion is equipped with a frusto-conical extension formed thereon with a circular bore formed therein. The central portion preferably has an elongated slot formed therein along an entire length thereof for reasons that will soon become apparent. Next provided is a disk-shaped end cap including a cylindrical protrusion extending from a first face of the end cap in coaxial relationship therewith. Note FIG. 3. A second side face of the end cap has a diametrically disposed slot formed therein. During use, the cylindrical protrusion is removably coupled with the circular bore of one of the ends of the rod. As shown in FIG. 2, an elastic cord is provided having a constant circular cross-section along a length thereof. The cord includes a pair of ends each with a sphere integrally coupled thereto. A first one of the spheres may be removably situated within the circular bore of one of the ends of the rod. A second one of the spheres may be employed to couple the associated end of the cord within the slot of the end cap such that the cord remains in parallel with the rod. It should be noted that the permanent rods may be removably and spacedly situated within hair of a user prior to a permanent. Also included is a film lining an outer surface of each of the rods and end caps. In operation, the film is adapted to change color only when coming in contact with a predetermined chemical. Finally, a permanent wave solution has the predetermined chemical mixed therewith. As such, upon the application of the wave solution to the hair, only the film of the permanent rods which come in contact with the predetermined chemical change color. This indicates that the hair has the wave solution applied thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new color changing permanent rod system apparatus and method which has many of the advantages of the permanent rods mentioned heretofore and many novel features that result in a new color changing permanent rod system which is not anticipated, rendered obvious, suggested, or even implied by any of the prior art permanent rods, either alone or in any combination thereof.

It is another object of the present invention to provide a new color changing permanent rod system which may be easily and efficiently manufactured and marketed.

It is a further object of the present invention to provide a new color changing permanent rod system which is of a durable and reliable construction.

An even further object of the present invention is to provide a new color changing permanent rod system which is susceptible of a low cost of manufacture with regard to both materials and labor, and which accordingly is then susceptible of low prices of sale to the consuming public, thereby making such color changing permanent rod system economically available to the buying public.

Still yet another object of the present invention is to provide a new color changing permanent rod system which provides in the apparatuses and methods of the prior art some of the advantages thereof, while simultaneously overcoming some of the disadvantages normally associated therewith.

Still another object of the present invention is to provide a new color changing permanent rod system for indicating whether hair has a permanent wave solution applied thereto.

Even still another object of the present invention is to provide a new color changing permanent rod system including rods which change color in response to a solution coming contact therewith for the purpose of indicating that the hair has the solution applied thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
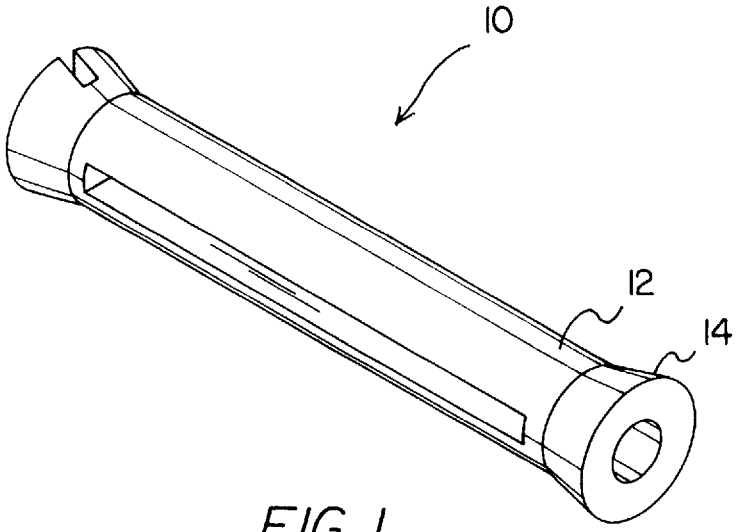
FIG. 1 is a perspective view of a new color changing permanent rod system according to the present invention.

With reference now to the drawings, and in particular to FIGS. 1 through 5 thereof, a new color changing permanent rod system embodying the principles and concepts of the present invention and generally designated by the reference numeral 10 will be described.

The present invention, designated as numeral 10, includes a plurality of permanent rods 12. Each rod includes a central portion having a cylindrical configuration and a pair of ends. Each end of the central portion is equipped with a frusto-conical extension 14 formed thereon with a circular bore bored therein. The central portion preferably has an elongated slot formed therein along an entire length thereof for reasons that will soon become apparent.

Next provided is a disk-shaped end cap 16 including a cylindrical protrusion extending from a first face of the end cap in coaxial relationship therewith. Note FIG. 3. A second side face of the end cap has a diametrically disposed slot formed therein. During use, the cylindrical protrusion is removably coupled with the circular bore of one of the ends of the rod.

Figure 2:
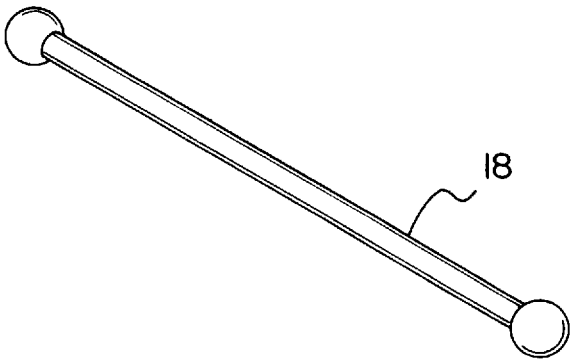
FIG. 2 is a perspective view of the elastic cord of the present invention.
Figure 3:
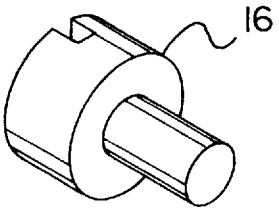
FIG. 3 is a perspective view of the end cap of the present invention.
Figure 4:
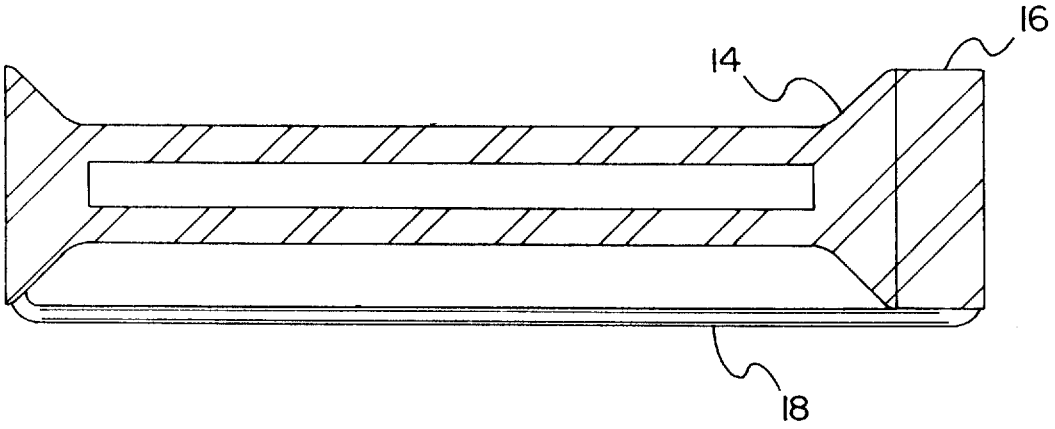
FIG. 4 is a side view of the present invention prior to the application of the permanent wave solution.
Figure 5:
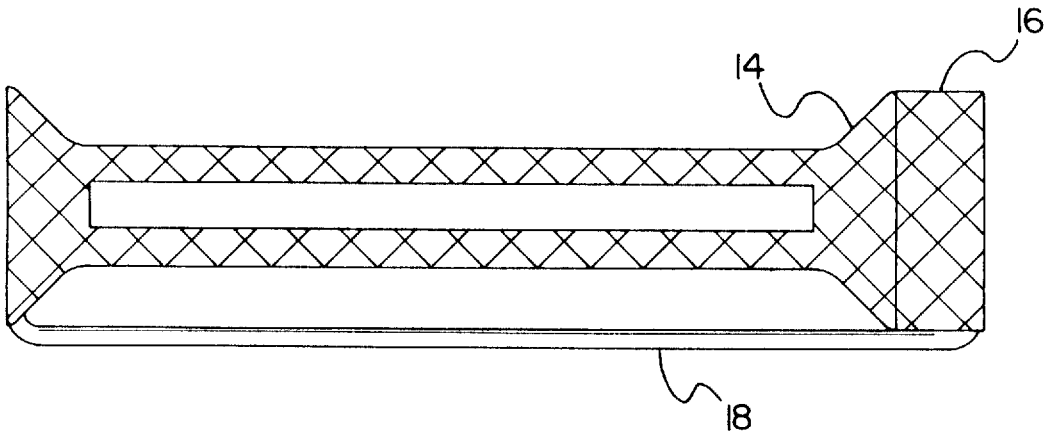
FIG. 5 is a side view of the present invention after the application of the permanent wave solution.

As shown in FIG. 2, an elastic cord 18 is provided having a constant circular cross-section along a length thereof. The cord includes a pair of ends each with a sphere integrally coupled thereto. A first one of the spheres may be removably situated within the circular bore of one of the ends of the rod. A second one of the spheres may be employed to couple the associated end of the cord within the slot of the end cap such that the cord remains in parallel with the rod. It is now apparent that the permanent rods may be removably and spacedly situated within hair of a user prior to a permanent. In various alternate embodiments, various other types rods may be employed.

Also included is a chemical film lining an outer surface of each of the rods and end caps. Such film is preferably viscous and thinly applied so as to remain on the rod and further not be readily noticeable to a user. It should be noted that the film may be incorporated with the rods as a component thereof during manufacture. In operation, the film is adapted to change color only when coming in contact with a predetermined chemical. It should be understood that chemicals which change color when coming into contact with each other are commonly known and readily available.

Finally, an unillustrated permanent wave solution has the predetermined chemical mixed therewith. As such, upon the application of the wave solution to the hair, only the film of the permanent rods which come in contact with the predetermined chemical change color. This indicates that the hair surround the rod has the wave solution applied thereto. During the process associated with the apparatus of the present invention, a user may apply the solution to hair that surrounds the rods which have not changed color. As such, a user may be assured that all of the hair has received the solution.

In the preferred embodiment, one of the following color changes is employed in the present invention:

red-to-maroon;
pale yellow-to-golden brown;
ocean reef blue-to-phthalo blue;
pink angle-to-gypsy rose;
dolphin grey-to-hippo grey;
white-to-light grey;
lilac-to-purple; or
island coral-to-desert orange.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A permanent rod system for indicating the presence of hair solution comprising, in combination:

a plurality of permanent rods each comprising, in combination:

a rod including a central portion having a cylindrical configuration and a pair of ends each with a frusto-conical extension formed thereon with a circular bore formed therein, the central portion having an elongated slot formed therein along an entire length thereof, a disk-shaped end cap including a cylindrical protrusion extending from a first face of the end cap in coaxial relationship therewith, a second side face of the end cap having a diametrically disposed slot formed therein, whereby the cylindrical protrusion is removably coupled with the circular bore of one of the ends of the rod, and an elastic cord having a constant circular cross-section along a length thereof, the cord including a pair of ends each with a sphere integrally coupled thereto, whereby a first one of the spheres may be removably situated within the circular bore of one of the ends of the rod and a second one of the spheres may be employed to couple the associated end of the cord within the slot of the end cap such that the cord remains in parallel with the rod, whereby the permanent rods may be removably and spacedly situated within hair of a user prior to a permanent;

a film lining an outer surface of each of the rods and end caps, the film adapted to change color only when coming in contact with a predetermined chemical; and a permanent wave solution having the predetermined chemical mixed therewith, whereby upon the application of the wave solution to the hair, only the film of the permanent rods which come in contact with the predetermined chemical change color thereby indicating that the hair has the wave solution applied thereto.

2. A plurality of hair rods adapted to change color in response to a solution coming contact therewith for the purpose of indicating that hair surrounding the rod has the solution applied thereto.

3. A plurality of hair rods as set forth in claim 2 wherein each rod includes a central portion having a cylindrical configuration and a pair of ends each with a frusto-conical extension formed thereon with a circular bore formed therein, the central portion having an elongated slot formed therein along an entire length thereof, a disk-shaped end cap including a cylindrical protrusion extending from a first face of the end cap in coaxial relationship therewith, a second side face of the end cap having a diametrically disposed slot formed therein, whereby the cylindrical protrusion is removably coupled with the circular bore of one of the ends of the rod, and an elastic cord having a constant circular cross-section along a length thereof, the cord including a pair of ends each with a sphere integrally coupled thereto, whereby a first one of the spheres may be removably situated within the circular bore of one of the ends of the rod and a second one of the spheres may be employed to couple the associated end of the cord within the slot of the end cap such that the cord remains in parallel with the rod.

4. A plurality of hair rods as set forth in claim 2 wherein a film lines an outer surface of each of the rods and end caps, the film adapted to change color only when coming in contact with a predetermined chemical which is mixed with the solution.

5. A plurality of hair rods as set forth in claim 2 wherein the solution is permanent wave solution.

6. A process for indicating the presence of hair solution in hair comprising the steps of:

providing a plurality of hair rods with a film adapted to change color upon coming in contact with a predetermined chemical;

inserting each rod within hair of a user;

applying a hair solution to the hair, whereby upon the application of the hair solution to the hair, only the film of the rods which comes in contact with the predetermined chemical change color thereby indicating that the hair has the hair solution applied thereto; and applying the hair solution to hair surrounding rods which have not changed color.

* * * * *